US007574963B2

(12) United States Patent
Reichel et al.

(10) Patent No.: US 7,574,963 B2
(45) Date of Patent: Aug. 18, 2009

(54) METHOD FOR THE PRECISE POSITIONING OF A CARRIER FOR A TRACK, AND CORRESPONDING TRACK

(75) Inventors: Dieter Reichel, Neumarkt (DE); Ralf Waidhauser, Neumarkt (DE)

(73) Assignee: Max Bögl Bauunternehmung GmbH & Co. KG, Neumarkt (DE)

( * ) Notice: Subject to any disclaimer, the term of this patent is extended or adjusted under 35 U.S.C. 154(b) by 282 days.

(21) Appl. No.: 10/579,574

(22) PCT Filed: Nov. 17, 2004

(86) PCT No.: PCT/EP2004/052998

§ 371 (c)(1),
(2), (4) Date: May 17, 2006

(87) PCT Pub. No.: WO2005/049921

PCT Pub. Date: Jun. 2, 2005

(65) Prior Publication Data

US 2007/0125257 A1 Jun. 7, 2007

(30) Foreign Application Priority Data

Nov. 18, 2003 (DE) ..... 103 53 949

(51) Int. Cl.
*B61B 12/04* (2006.01)

(52) U.S. Cl. ..... 104/124; 104/121

(58) Field of Classification Search ..... 104/118, 104/121, 281, 282, 286; 238/264, 281
See application file for complete search history.

(56) References Cited

U.S. PATENT DOCUMENTS 4,698,895 A 10/1987 Miller et al.

(Continued)

FOREIGN PATENT DOCUMENTS

CA 2 323977 A1 4/2002

(Continued)

OTHER PUBLICATIONS

German Patent Office Search Report, Sep. 16, 2004.

(Continued)

*Primary Examiner*—S. Joseph Morano
*Assistant Examiner*—Robert J McCarry, Jr.
(74) *Attorney, Agent, or Firm*—Dority & Manning, P.A.

(57) ABSTRACT

The invention relates to a method for the precise positioning of a carrier (1) for the track of a railborne vehicle, especially a magnetic levitation railway. Said carrier comprises a track plate (3) provided with guiding elements for the vehicle, and at least one, preferably two, connecting elements (5) which protrude essentially at a right angle from the track plate. The carrier is discretely mounted on a bed (7). The carrier and a compensation sleeper (2) are separately produced, and the carrier, compensation sleeper (2), and bed are then interconnected. A fine adjustment of the pre-determined spatial curve of the carrier is carried out between the carrier and the compensation sleeper and/or between the compensation sleeper and the bed. The invention also relates to a track of a railborne vehicle, especially a magnetic levitation railway, comprising a carrier provided with a track plate having guiding elements for the vehicle, and at least one, preferably two connecting elements which protrude essentially at a right angle from the track plate, said carrier being discretely mounted on a bed. A compensation sleeper is arranged as an autonomous component between the carrier and the bed. Said carrier is connected to the compensation sleeper by means of the connecting sections, and the compensation sleeper is connected to the bed.

13 Claims, 5 Drawing Sheets

U.S. PATENT DOCUMENTS

| | | | | |
|---|---|---|---|---|
| 6,782,832 | B2 | 8/2004 | Reichel et al. | |
| 2005/0166786 | A1* | 8/2005 | Reichel et al. | 104/124 |
| 2006/0032395 | A1 | 2/2006 | Matuschek et al. | |

FOREIGN PATENT DOCUMENTS

| | | | |
|---|---|---|---|
| DE | 297 23163 | U1 | 6/1998 |
| DE | 102 37176 | A1 | 3/2004 |
| DE | 103 21047 | A1 | 8/2004 |

OTHER PUBLICATIONS

PCT Search Report, Feb. 25, 2005.
International Preliminary Report, Sep. 19, 2006.

* cited by examiner

METHOD FOR THE PRECISE POSITIONING OF A CARRIER FOR A TRACK, AND CORRESPONDING TRACK

FIELD OF THE INVENTION

The invention relates to a method for the precise positioning of a carrier for a track of a rail-borne vehicle, in particular a magnetic levitation railway, whereby the carrier is provided with a track plate with guide elements for the vehicle on it and with at least one, preferably two connecting elements extending essentially at right angles from the track plate, and whereby the carrier is borne discretely on a bed, as well as to a corresponding track.

BACKGROUND

U.S. Pat. No. 4,698,895 discloses a track carrier of this type with a track plate with guide elements for the vehicle located on the outer ends of an upper chord. Two connecting elements extend essentially at right angles from this track plate and are connected to each other in a semi-circular manner at the end away from the track plate. At either end of the track carrier bearing, brackets are provided on which the carrier is supported. The bearing brackets are integrated into the track carriers made of concrete. It is a disadvantage in that case that special track carriers with bearing brackets adapted to the curve inclination must be produced as a function of the track course, i.e. in particular in curves. For this reason, a great number of individual carriers is required, their production being very time consuming and cost intensive.

SUMMARY

It is an object of the present invention to create an economic track carrier that can be produced rapidly in great numbers. Additional objects and advantages of the invention will be set forth in part in the following description, or may be obvious from the description, or may be learned through practice of the invention.

With method embodiments according to the invention for precise positioning of a carrier for a track of a railborne vehicle, in particular a magnetic levitation railway, the carrier is provided with a track plate with guide elements installed on it for the vehicle and at least one, preferably two connecting elements. The connecting elements extend essentially at right angles from the track plate. The carrier according to the invention is not continuous but is supported discretely on a bed.

The carrier and a compensation sleeper may be produced separately, the carrier, the compensation sleeper and the bed being then connected to each other, and at the same time a fine adjustment of the predetermined spatial curve of the carrier is made. By means of the method according to the invention, the carrier can always be produced in the same way. Mass production of the carrier is thereby very easy and possible. Similarly, the same kind of compensation sleeper can be used in many instances. Fine adjustment which is required in order to achieve the predetermined spatial curve of the carrier can be produced in combining the carrier and the compensation sleeper or the compensation sleeper and the bed. Only in case of great divergence is an individual compensation sleeper made which is of very simple design and can therefore be produced rapidly, easily and economically. With the method according to the invention, it is possible to rapidly produce a track for a magnetic levitation railway.

The fine adjustment between the carrier and the compensation sleeper and/or between the compensation sleeper and the bed can be effected by means of spindles. The spindles are placed in such manner in that case that the predetermined spatial curve of the carrier, especially at that location, is achieved precisely.

During the adjustment, a gap is produced between the carrier and the compensation sleeper and/or between the compensation sleeper and the bed. This gap is advantageously filled with a casting compound. The casting compound hardens after a certain time and fixes the adjustment of the carrier.

If the casting compound is selected in such manner that it allows for a longitudinal shifting of the carrier on the bed or the compensation sleeper, longitudinal elongation such as may occur e.g. as a result of heat expansion, can be compensated for.

If the carrier is supported in an elastic manner on the bed or on the compensation sleeper, the oscillations of the carrier are absorbed so that an even, quiet and acoustically dampened operation of the track is possible. Furthermore the elastic support of the carrier allows for its longitudinal changes without any occurrence of warping.

To be able to position a carrier in a defined manner for the connections to the next carrier, it is advantageous to fix the carrier via at least one fixed bearing on the bed or on the compensation sleeper.

For an especially precise adjustment of the carrier, it is advantageous if the carrier is underpoured with the casting compound when it is under load. The position of the carrier, in particular when a vehicle travels over it, is thereby defined.

A track for a railborne vehicle according to embodiments of the invention, in particular a magnetic levitation railway, is provided with a carrier. The carrier consists of a track plate with guide elements on it for the vehicle and with at least one, preferably two connecting elements extending essentially at right angles from the track plate. The carrier is supported discretely on the bed, i.e. not over its entire length but merely at separate bearing points.

A compensation sleeper is installed as an independent component between the carrier and the bed. The carrier is connected to the compensation sleeper and the compensation sleeper is connected to the bed via the carrier's connection elements. The carrier that can be used for the track according to the invention is produced rapidly and on an industrial scale as an always-identical mass-produced part. The required precision in laying out the track is obtained by means of a compensation sleeper that is a separate component. The fine adjustment of the carrier relative to the layout of the track is achieved through the connection of the carrier with the compensation sleeper and/or through the positioning of the compensation sleeper on the bed. A track of this kind can be built in a very individual manner with few parts that are different from each other.

In order to fix a given position of the carrier on the track, underpouring connects the carrier and the compensation sleeper and/or the compensation sleeper and the bed. Concrete or elastomer can be used for example as the casting compound in that case.

To attach the carrier and/or the compensation sleeper, the carrier and the compensation sleeper or the compensation sleeper and the bed are connected to each other by means of a bearing structure. The bearing structure is advantageously provided with a lifting safety for the carrier and/or a longitudinal compensation possibility and/or a transversal fixing of the carrier. The carrier is reliably held in its predetermined position by means of such a bearing structure. This is very important especially when a vehicle passes over it. The bearing structure must be able to bear great forces under certain circumstances.

At different bearing points, it is advantageous for the carrier and the compensation sleeper and/or the compensation sleeper and the bed tp be connected to each other by means of a fixed bearing. Positioning of the carrier is thereby defined. An additional bearing that allows for elongation of the carrier, ensures that warping of the carrier in case of temperature expansion is reliably avoided.

An especially simple and reliable support of the carrier is achieved by providing a mounting plate at the end of the connecting element assigned to the compensation sleeper. The mounting plate can be attached in the connecting element e.g. by means of screw or tie rods in order to be able to bear the great forces which are introduced via the mounting plate into the compensation sleeper.

A bearing plate is installed on the compensation sleeper across from the mounting plate. Bearing plate and mounting plate correspond to each other and are used for a defined support of the carrier on the compensation sleeper. A movable bearing or a fixed bearing can be produced as a function of the connections between the mounting plate and the bearing plate. The fixed bearing is advantageously produced in that the bearing plate and the mounting plate are connected to each other by means of a holding mandrel. This very simple design has also been shown to be very easily assembled.

If the mounting plate interacts with a transversal fixing and a lifting safety, the guidance of the carrier in both transversal directions relative to the longitudinal axis of the carrier is achieved.

If bracing is provided between the compensation sleeper and the bed, the compensation sleeper is fixed firmly on the bed. Support of the carrier by means of fixed or movable bearing is advantageous in that case between the carrier and the compensation sleeper so as to be able to compensate for elongations of the carrier.

If casting compound is poured between the compensation sleeper and the bed, the compensation sleeper is fixed in a defined manner. Depending on the type of casting compound selected, damping of the carrier relative to the bed can be produced in that case.

The track according to the invention relates in particular to a carrier that has add-on components with the guide elements to guide and/or drive the vehicle on the longitudinal faces of the track plate that is at the same time the upper chord of the carrier.

It is especially advantageous if the carrier is a prefabricated concrete part. The carrier can thus be produced very rapidly on an industrial scale.

In supporting and pouring the casting compounds, it is often advantageous if any longitudinal shifting of the carrier relative to the bed is made possible. This is advantageously based on the assumption that the bed is mainly in an unchangeable position while the carrier will be subject to longitudinal changes due to the rays of the sun and other temperature influences. To avoid warping of the carrier, this longitudinal shifting relative to the bed is advantageous.

The connecting elements on the track plate are essentially at right angles to the track plate. This also means that the connecting elements are somewhat spread out toward the outside and converge toward the inside.

Additional advantages of the invention are described in the following examples of embodiments.

DESCRIPTION

Figure 1:
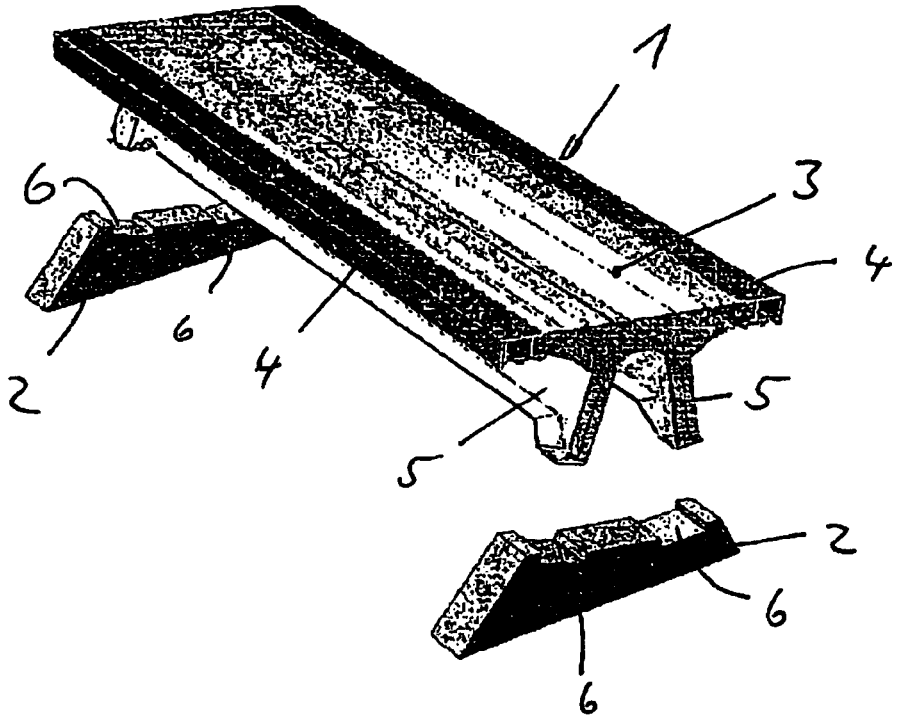
FIG. 1 shows a view in perspective of a carrier and two compensation sleepers.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

FIG. 1 shows a perspective view of a carrier 1 with two compensation sleepers 2 assigned to it. The carrier 1 consists of a track plate 3 representing the upper chord of the carrier 1. On the longitudinal sides of the track plate 3 are add-on elements 4 which are guide elements for a magnetic levitation vehicle. Two connecting elements 5 extend essentially at right angles from the track plate 3. The connecting elements may be slightly spread out toward the outside in order to achieve additional stability of the carrier 1. The ends of the connecting elements 5 away from the track plate 3 match corresponding indentations 6 in the compensation sleepers 2. The ends of the connecting elements 5 are inserted into these indentations 6 and are connected to the compensation sleeper 2.

Figure 2:
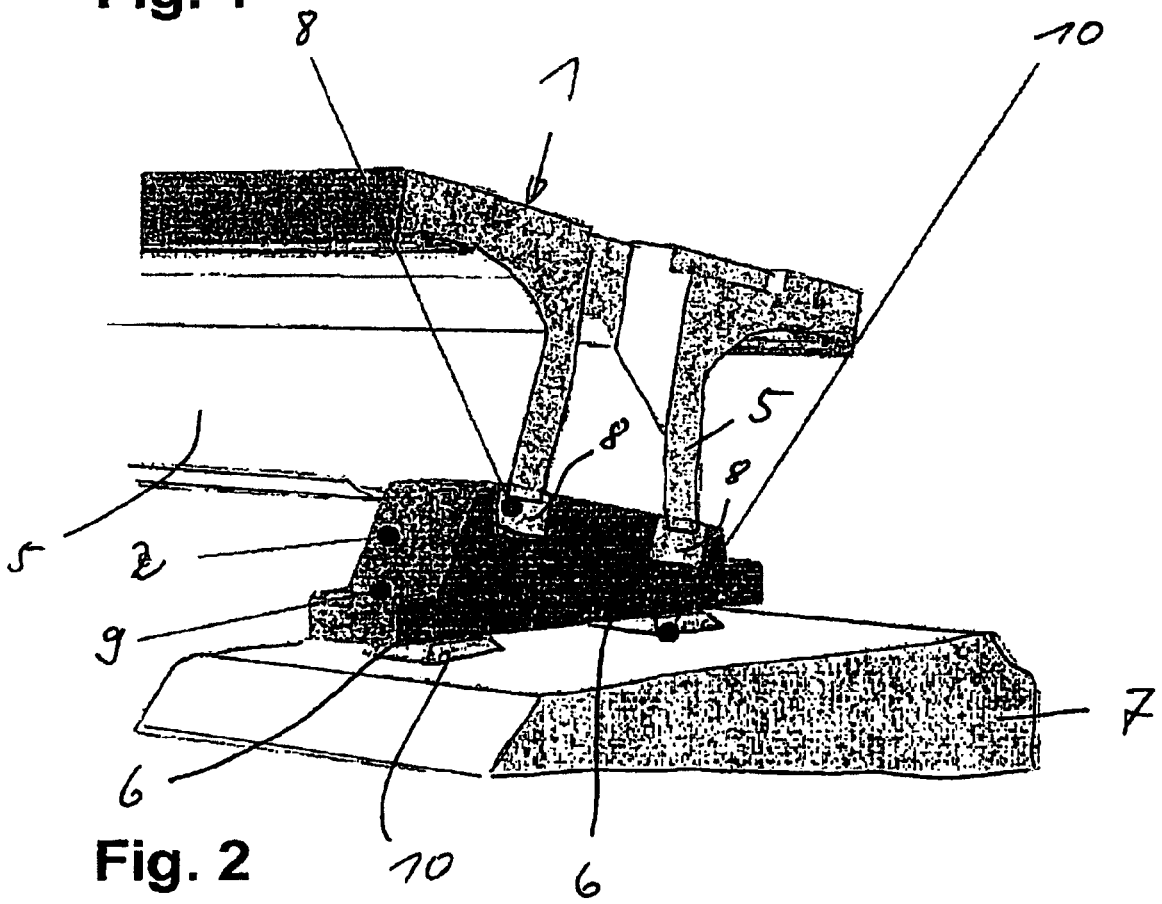
FIG. 2 shows a perspective view of an assembled carrier with its compensation sleeper on a pedestal.

FIG. 2 shows a view in perspective of the carrier 1 which is connected to the bed 7 by means of the compensation sleeper 2. The bed 7 can be made in form of a pedestal, a column or a continuous band.

The carrier 1 is fixedly connected to the compensation sleeper 2. For this purpose the carrier 1 is fixedly held by poured casting compound 8 via its connecting elements 5 in the indentations 6 of the compensation sleeper 2. The indentations 6 are filled with a casting compound 8 following precise positioning of the carrier 1 and of the compensation sleeper 2, and thus fix the carrier 1 relative to the compensation sleeper 2. The precise positioning of the carrier 1 and the compensation sleeper 2 is effected as a function of the individual requirements on the track course. For this purpose, provisions may also be made for the carrier 1 to be brought into its precise position relative to the compensation sleeper 2 by means of spindles provided between the connecting element 5 and the indentation 6 of the compensation sleeper 2, this position being then fixed by means of the casting compound 8 poured into the indentations 6. The compensation sleeper 2 is held on the bed 7 by means of threaded steel rods 9. The position of the compensation sleeper 2 is fixed on the bed 7 by means of an underpoured casting compound 10.

Figure 3:
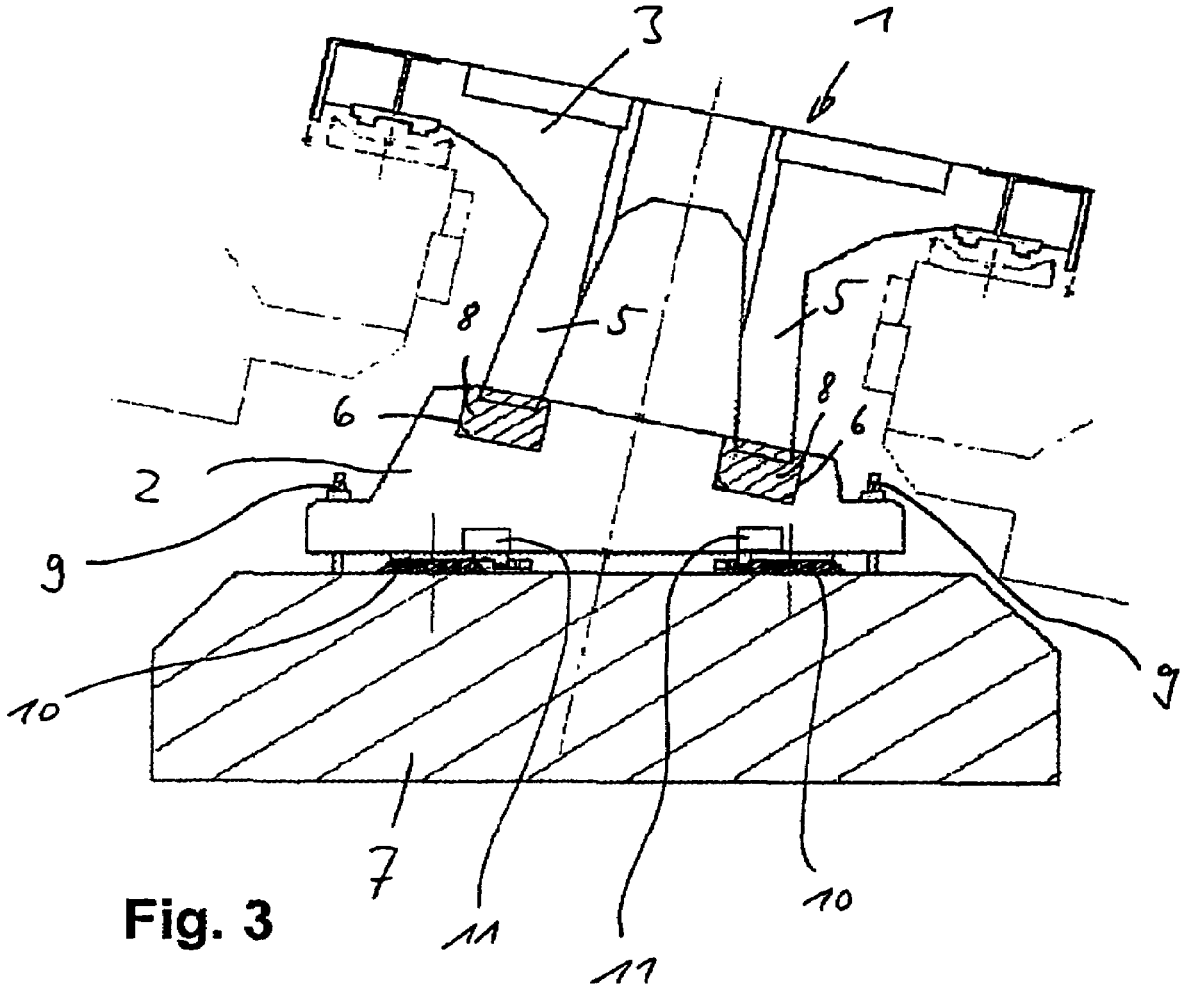
FIG. 3 is a view of the face of a track as in FIG. 2.

FIG. 3 shows a frontal view of the carrier attachment from FIG. 2. The carrier 1 is attached in the indentations 6 of the compensation sleeper 2 with its two connecting elements 5 which are slightly spreading out as the extend from the track plate 3. The attachment is achieved by means of the casting compounds 8. The connecting elements 5 can be held in the indentation 6 by means of threaded spindles that are not shown. The precise position of the carrier 1 relative to the compensation sleeper 2 is fixed in this case by the casting compound 8. This placement of the carrier 1 by means of spindles is advantageous when the carrier 1 is connected at the building site to the compensation sleeper 2 and is brought into its precise position only at that site. If the connection between carrier 1 and compensation sleeper 2 is already established at the factory, positioning of the carrier 1 and of the compensation sleeper 2 relative to each other is possible with the supporting equipment not shown here. The mutual position is then again fixed by means of the casting compound 8.

In order to achieve an especially good connection between the carrier 1 and the compensation sleeper 2, it may also be advantageous to provide head bolts at the ends of the connecting elements 5 to extend into the indentations 6 and to be connected ideally with the casting compound 8. The head bolts can be installed on a plate that is screwed on to or held on the underside of the connecting elements 5, thus creating an ideal connection of the head bolts to the connecting element 5 via the plate. The connection can of course also be achieved by means of clip irons extending from the underside of the connecting elements 5 and possibly from the compensation sleeper 2 into the indentations 6.

The compensation sleeper 2 is held by means of threaded steel rods 9 extending from the bed 7 and of a nut which attaches the compensation sleeper 2. Retention takes place against a bearing 11 which is located between the compensation sleeper 2 and the bed 7. The position of the compensation sleeper 2 that has been selected is fixed by means of the casting compound 10 poured between the compensation sleeper 2 and the bed 7.

The form of the compensation sleeper 2 is not limited to the embodiment shown here. The principle of the invention, according to which the very costly carrier 1 is always as much as possible a uniform part throughout the entire track, is made possible by means of the compensation sleeper 2. The compensation sleeper 2 which may also be of uniform form in many cases, can however be easily modified since it is a very simple component. Thus for example, a wedge-shaped compensation sleeper 2 as shown here can be used in curves of the track. On straight segments of the track it is however also possible for the compensation sleeper 2 to be essentially rectangular with parallel top and underside. The fine adjustment of the precise course of the carrier 1 can be effected at the connection points between the carrier 1 and the compensation sleeper 2 as well as also between the compensation sleeper 2 and the bed 7. Thus many adjustment possibilities exist which can be fixed in the desired position so that the most diverse track courses can be realized with one standard component design of the carrier 1.

Figure 4:
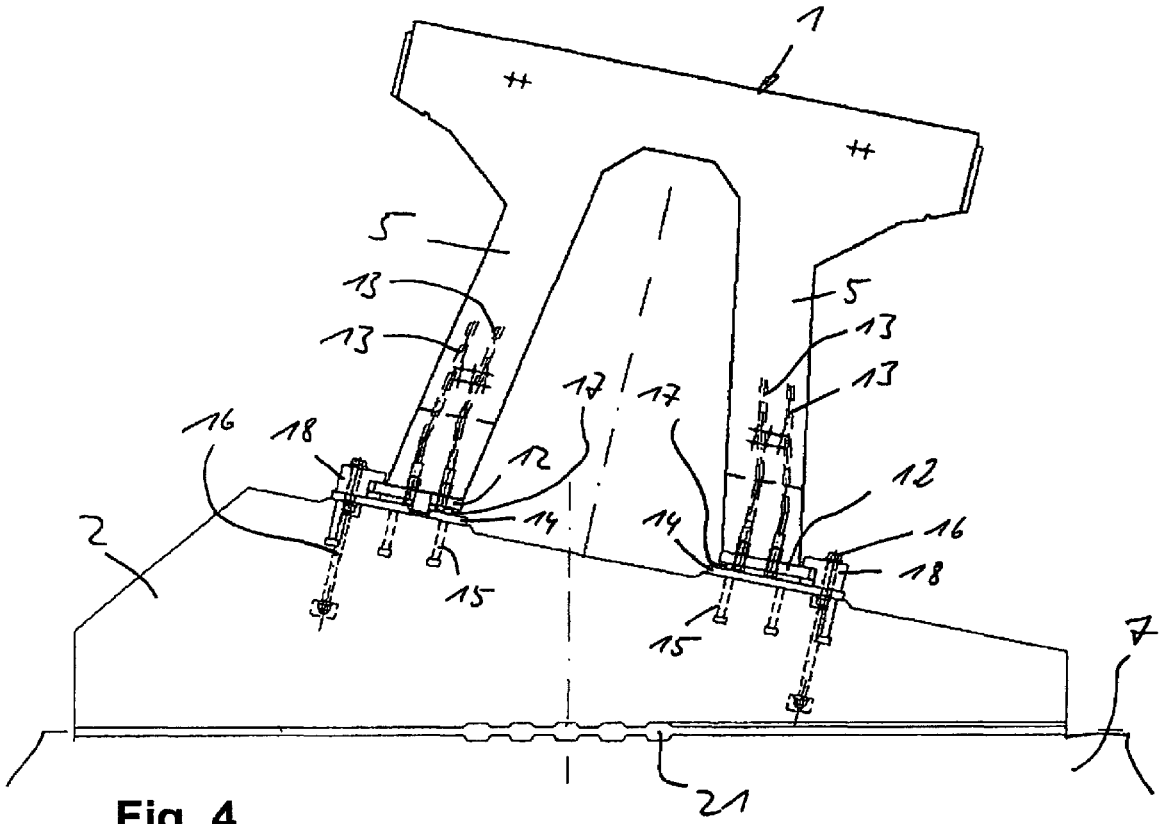
FIG. 4 shows the face of an alternative assembly of carrier and compensation sleeper.

FIG. 4 shows an alternative of the previously described combinations of the carrier 1 with the compensation sleeper 2 and the bed 7. The connecting elements 5 are provided with mounting plates 12 on their undersides and these are fastened to the connecting elements 5. The attachment can be effected by means of steel rods 13 with threaded sleeves embedded in the connecting elements 5 into which screws are screwed which press the mounting plate 12 against the underside of the connecting element 5. In order to create an especially strong connection, additional bonding of the mounting plate 12 to the underside of the connecting element 5 can be used. Across from the mounting plate 12 and on the compensation sleeper 2, a bearing plate 14 is provided. The bearing plate 14 is attached by means of head bolts 15 in the compensation sleeper 2. In addition it is fastened by means of draw spindles 16 to the compensation sleeper 2. An elastomer layer 17 is provided between the mounting plate 12 and the bearing plate 14 to ensure a connection between the carrier 1 and the compensation sleeper 2.

In order to secure the position of the carrier 1 on the compensation sleeper 2, claw-like clamps 18 are provided and are attached to the bearing plate 14. The claws 18 ensure lateral retention and lift prevention of the carrier 1. They correspond to an overhang of the bearing plate 14 over the connecting element 5. If the carrier 1 tends to tilt or shift laterally, e.g. because of its load when a vehicle drives across it, it bears against the claws 18 and is retained in its position. The claws 18 are positioned so that they divert the forces produced in lifting or lateral shifting into the bearing plate 14 or the compensation sleeper 2.

The compensation sleeper 2 is connected by poured casting compound to the bed 7. In order to ensure stable positioning of the compensation sleeper 2 on the bed 7, the bed 7 and/or the compensation sleeper 2 are provided with teeth 21 in longitudinal and transversal direction in the casting area. Thereby, a secure connection between the compensation sleeper 2 and the bed 7 is created.

Figure 5:
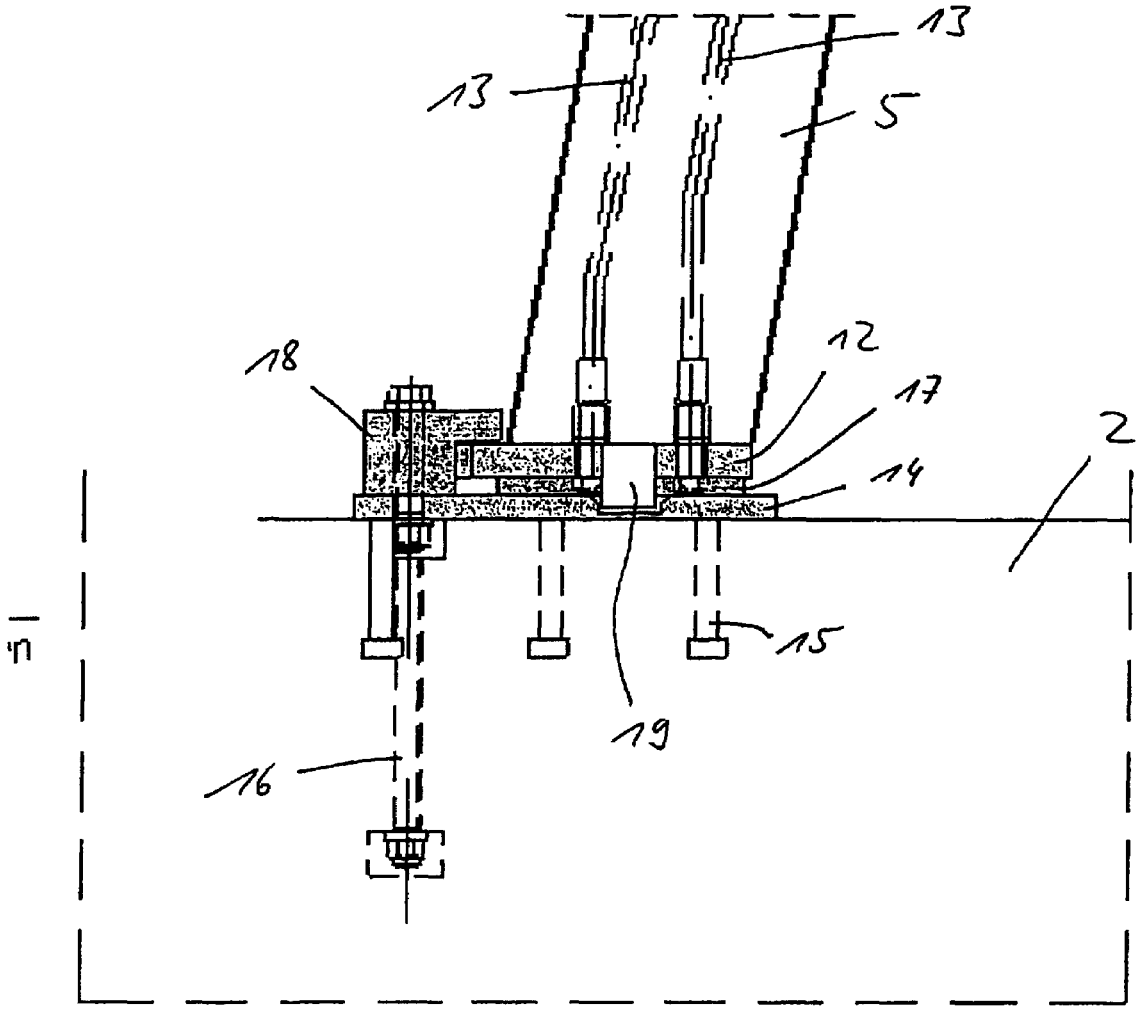
FIG. 5 shows a detail of a carrier attachment and FIG. 6 shows an alternative embodiment.

FIG. 5 shows an enlarged illustration of the fastening of the left connecting element 5 of FIG. 4. The mounting plate 12 is fixedly screwed into the threaded sleeves of the rods 13. The overhang of the mounting plate 12 is held by the claw 18. The claw 18 is attached by means of a screw to the bearing plate 14. The bearing plate 14 is installed in the compensation sleeper 2 by means of head bolts 15 and draw spindles 16. The elastomer layer 17 is located between the mounting plate 12 and the bearing plate 14 for damping and precise positioning of the carrier.

By contrast with the bearing design of the right-hand connecting element 5 of FIG. 4, the bearing design of this left-hand connecting element 5 shown here in FIG. 5 is provided with an additional holding mandrel 19. This holding mandrel 19 traverses the mounting plate 12 and reaches into the bearing plate 14. This causes this bearing to be a fixed bearing which extensively prevents a longitudinal or lateral shifting of the carrier 1 on the compensation sleeper 2. The bearing design of the right hand connecting element 5 without holding mandrel 19 is on the other hand a movable bearing allowing for longitudinal expansion of the carrier 1.

Figure 6:
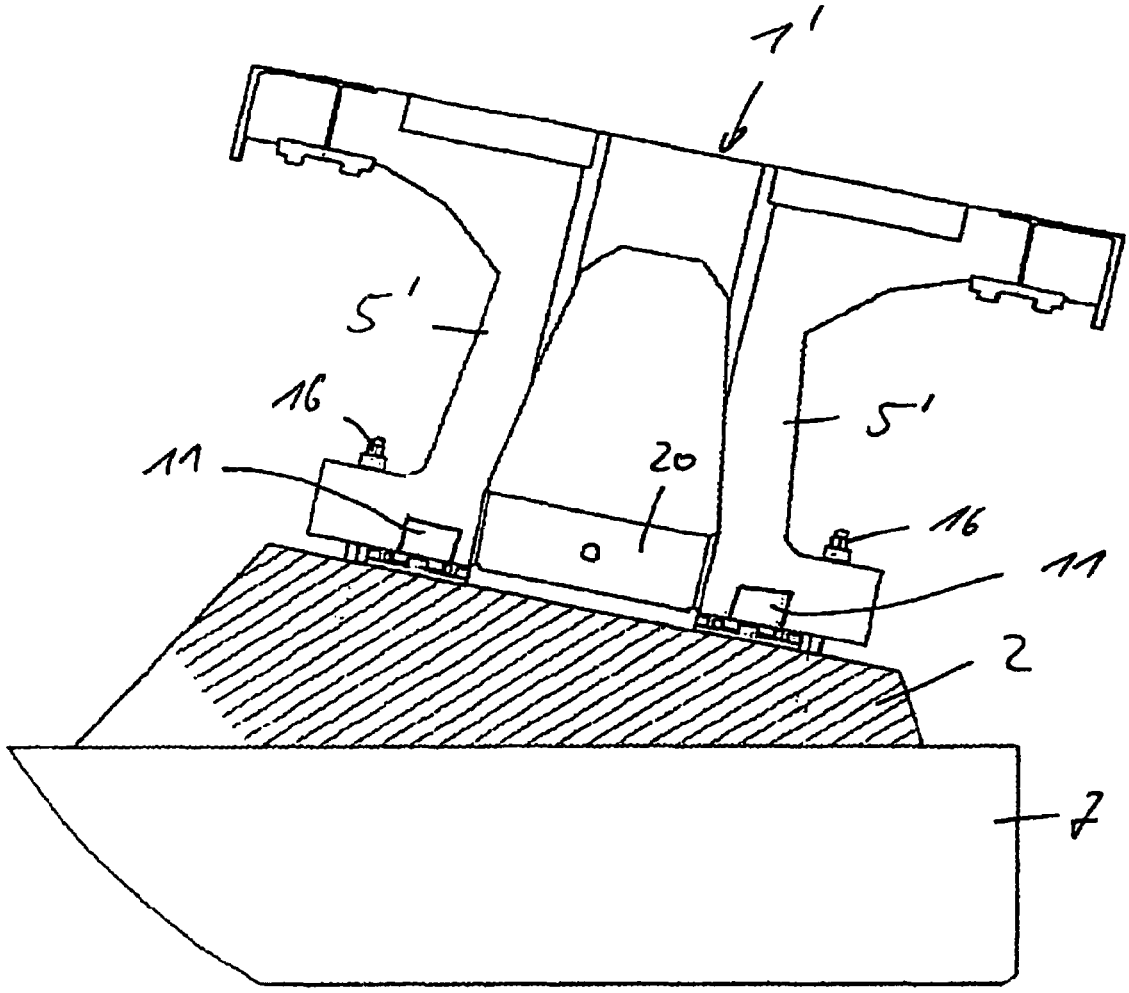

A further example of an embodiment of the present invention is shown in FIG. 6. Here the compensation sleeper 2 is held on the bed by casting or screwing. A carrier 1' is attached to the compensation sleeper 2. The attachment is similar to that of the compensation sleeper 2 in FIG. 3. A threaded steel rod 9 holds the carrier 1' via its modified connecting elements 5' on the compensation sleeper 2 against the bearing 11. The area between the underside of the carrier 1' and the top of the compensation sleeper 2 can be filled with a casting compound. To further stabilize the carrier, the carrier 1' is provided with a reinforcement plate 20 in this embodiment which further stabilizes the carrier 1'.

The present invention is not limited to the embodiments shown. In particular combinations of the different supports and attachments of the components according to the invention also come under the protection of the invention.

The invention claimed is:

1. A track system for a railborne vehicle, comprising:

a carrier defining a track plate and having connecting elements extending transversely from an underside of said track plate, said carrier supported on a bed;

a compensation sleeper formed independent from said carrier and disposed on a top surface of said bed and extending under each of said connecting elements of said carrier, said compensation sleeper connected to said bed and said connecting elements connected to said compensation sleeper; and an adjustment mechanism whereby a desired spatial position of said carrier is achieved by fine adjustment of relative positions between said compensation sleeper and said bed, or said connecting elements and said compensation sleeper.

2. The system as in claim 1, further comprising a casting compound poured between said connecting elements and said compensation sleeper, or between said compensation sleeper and said bed to fix a final adjusted position of said compensation sleeper and said carrier relative to said bed.

3. The system as in claim 1, further comprising a fixed bearing arrangement between at least one of said connecting elements and said compensation sleeper, or between said compensation sleeper and said bed.

4. The system as in claim 1, further comprising a bearing arrangement between said connecting elements and said compensation sleeper, said bearing arrangement configured to prevent lift-off and lateral shifting of said carrier relative to said compensation sleeper.

5. The system as in claim 4, wherein said bearing arrangement is configured for longitudinal shifting between said connecting elements and said compensation sleeper.

6. The system as in claim 1, further comprising a mounting plate fixed to ends of said connecting elements, and bearing plates fixed to said compensation sleeper at points of attachment of said connecting elements to said compensation sleeper.

7. The system as in claim 1, further comprising a bracing device between said compensation sleeper and said bed.

8. The system as in claim 1, comprising an underpoured casting compound between said compensation sleeper and said bed.

9. The system as in claim 8, wherein said underpoured casting compound is configured for longitudinal shifting of said carrier relative to said bed.

10. The system as in claim 1, wherein said carrier and said compensation sleeper are prefabricated concrete elements.

11. A track system for a railborne vehicle, comprising:

a carrier defining a track plate and having connecting elements extending transversely from an underside of said track plate, said carrier supported on a bed;

a compensation sleeper formed independent from said carrier and disposed on a top surface of said bed and extending under each of said connecting elements of said carrier, said compensation sleeper connected to said bed and said connecting elements connected to said compensation sleeper; and an adjustment mechanism whereby a desired spatial position of said carrier is achieved by fine adjustment of relative positions between said compensation sleeper and said bed, or said connecting elements and said compensation sleeper;

a mounting plate fixed to ends of said connecting elements, and bearing plates fixed to said compensation sleeper at points of attachment of said connecting elements to said compensation sleeper; and further comprising a fixed mandrel through said mounting plates and said bearing plates, said fixed mandrel defining a fixed bearing between said connecting elements and said compensation sleeper.

12. The system as in claim 11, further comprising an elastomeric compensating material disposed between said mounting plates and said bearing plates.

13. The system as in claim 11, further comprising a claw-like clamp fixing said mounting plates against said bearing plates.

* * * * *

UNITED STATES PATENT AND TRADEMARK OFFICE

CERTIFICATE OF CORRECTION

PATENT NO. : 7,574,963 B2
APPLICATION NO. : 10/579574
DATED : August 18, 2009
INVENTOR(S) : Reichel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 374 days.

Signed and Sealed this

Seventh Day of September, 2010

David J. Kappos

David J. Kappos
*Director of the United States Patent and Trademark Office*